United States Patent [19]

Miln

[11] Patent Number: 4,598,949

[45] Date of Patent: Jul. 8, 1986

[54] SEATING PLATFORM

[75] Inventor: James P. Miln, Repton, England

[73] Assignee: Pirelli Limited, London, England

[21] Appl. No.: 671,510

[22] Filed: Nov. 15, 1984

[30] Foreign Application Priority Data

May 10, 1984 [GB] United Kingdom ..... 8412005
Aug. 1, 1984 [GB] United Kingdom ..... 8419627

[51] Int. Cl.[4] ..... A47C 7/02
[52] U.S. Cl. ..... 297/452; 5/402; 5/481; 297/455; 297/DIG. 1; 297/DIG. 2
[58] Field of Search ..... 297/452, 455, 461, DIG. 1, 297/DIG. 2; 5/481, 474, 402, 403, 404, 451, 405, 406; 248/345.1

[56] References Cited

U.S. PATENT DOCUMENTS

| | | | |
|---|---|---|---|
| 2,713,892 | 7/1955 | Knapp | 5/481 X |
| 3,431,023 | 3/1969 | Anderson | 297/452 |
| 3,724,009 | 4/1973 | Ambrose | 5/474 |
| 3,871,041 | 3/1975 | Plume | 5/402 |

*Primary Examiner*—James T. McCall
*Attorney, Agent, or Firm*—Scrivener Clarke Scrivener and Johnson

[57] ABSTRACT

A seating platform e.g. for domestic furniture or motor vehicle seats comprises at least one moulded elastic element mounted on a frame member and covered by a non-stretch sheet which, upon installation, is only lightly tensioned. The elastic element is of a substantially incompressible material, e.g. a rubber composition high in natural rubber, and includes spaced apart grooves which permit controlled transverse deformation of the element upon loading of the platform.

9 Claims, 8 Drawing Figures

SEATING PLATFORM

This invention relates to a seating platform exhibiting resilience under loading and suitable for use in all manner of seating, including domestic seats and seats for cars or other forms of transport.

A variety of resilient seating platforms have been used or proposed hitherto but all involve some degree of complexity, and therefore expense, in their manufacture or application to the seat frame. Typically, a seating platform might comprise a sheet made up of elastic and non-stretch pieces joined together, such that the procedure for installing the platform on the seat frame involves stretching the sheet across the seat frame and attaching its opposite edges to opposite frame members. The platform must be selected, both as regards its overall size and the size of the different elastic and non-stretch pieces, such that it will have an appropriate degree of resilience for the particular frame to which it is to be applied.

We have now devised a seating platform the components of which are straightforward to manufacture and to apply to the seat frame without requiring significant stressing of elastic elements, yet the same components are appropriate for a wide range of differently sized seat frames.

Thus, in accordance with this invention, there is provided a seating platform comprising an elongate elastic element disposed along at least one frame member of a seat, and a sheet of non-stretch material secured along opposite edges thereof to said one frame member and an opposite frame member so as to be taut when the seat is not loaded, said sheet lying over said elongate elastic element and the arrangement being such that upon loading the seat, tension thus imparted to said sheet produces elastic deformation of said elongate element, the elongate elastic element being so formed that its material is able to deform and expand along the lengthwise axis of the element to compensate for compression of the element along axes transverse to its length, so as to permit limited depression of the platform over its loaded region.

The elongate elastic element can simply be chosen of or cut to required length, the sheet of non-stretch material need simply be cut to length and then the elongate elastic element and the sheet of non-stretch material applied to the seat frame without any need for substantial manual or other force to stretch or otherwise stress any elastic component. In particular the sheet of non-stretch material need be applied under only relatively light tension.

We are aware of French specification No. 692 488 published in 1930, which at FIG. 13 shows a resilient seating platform which includes a piece of rubber apparently at one side of a seat frame and an element apparently attached to this one side of the seat frame, extending over the top of the rubber piece and extending apparently towards the opposite side of the seat frame. That arrangement differs considerably from all the other arrangements shown and described in the same specification and we are not aware of any practical seating platform having been made in accordance with that FIG. 13 nor are we aware of the precise arrangement which the inventor had in mind, but probably it was the intention for the element applied over the piece of rubber to be elastic so as to provide the required depression, at the centre of the platform, by its own stretching. In particular, if the piece of rubber were an elongate element and the overlying element non-stretch, the piece of rubber would be incapable of any significant degree of deformation to provide the necessary depression of the platform at its centre. The reason for this is that rubber is substantially incompressible, such that compression of a piece of rubber along one axis can only occur if that piece of rubber is able to deform and expand in a compensating manner along another axis: considering the piece of rubber shown in FIG. 13 of French specification No. 692 488, increasing the tension in the overlying platform element (in consequence of loading the platform) applies forces to the rubber piece tending to compress it along axes contained in the plane of the paper on which the illustration is drawn, but the rubber piece can only be compressed along these axes (to produce the depression which we seek at the centre of the platform) if the rubber piece can deform and expand in a compensating manner along the axis perpendicular to the plane of the paper. However, if the piece of rubber is elongate, it is impossible for it to so expand along its length, except adjacent its extreme ends.

Accordingly, a particular feature in accordance with our invention is that the elongate elastic element, which preferably comprises a high natural rubber content for retention of its elastic properties, is so formed (as mentioned above) that its material is able to deform and expand along the lengthwise axis of the element to compensate for compression of the element along axes transverse to its length, in response to increased tension in the sheet of non-stretch material. In a particular embodiment to be described herein, the elongate elastic element is formed with grooves, at intervals along its length, in a surface opposite the surface which is overlaid by the non-stretch sheet. The material is thus able to expand, in the lengthwise direction of the element, into these periodic grooves in order that such transverse compression of the element may occur as to provide the required depression at the centre of the platform upon loading, bearing in mind that the overlying sheet is non-stretch.

The elongate elastic element may be disposed along a single member of the seat frame, for example the front member. Instead, such elements may be disposed along two opposite frame members (either the front and back members or the opposite side members), or along all four frame members (front, back and two sides), in each case the non-stretch sheet lying over each elasatic element and all elements deforming under loading of the seat to contribute towards the required depression of the loaded region of the platform.

Preferably the or each elongate elastic element, once assembled into the seating platform, exhibits a first stage of deformation whereby the depression of the platform increases relatively greatly with applied load, followed by a second stage of deformation whereby the depression of the platform thereafter increases only relatively little with applied load. Thus there is significant depression of the platform upon a person first sitting down, whereafter some resilience remains for additional loading and variations in loading whilst the person remains seated yet the further depression will be small and the platform will provide a firm feel.

An embodiment of this invention will now be described, by way of example only, with reference to the accompanying drawings, in which.

Figure 1:
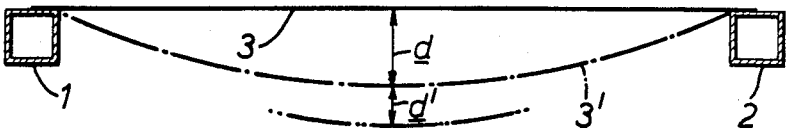
FIG. 1 is a diagrammatic section through a seating platform to explain the principles underlying this invention.

Reference will first be made to FIG. 1 to explain the basic principle of this invention, whether the platform is applied to domestic or other furniture seating or to seating for car or other forms of transport. Thus, in FIG. 1, opposite frame members 1,2 of a seat frame are shown, together with a sheet 3 of non-stretch material secured along its opposite edges to the frame members 1, 2 so as to be taut when the platform is unloaded. When the platform is loaded by a person sitting on it, the requirement is for the platform to depress to conform in profile to the applied load: thus the platform is required to depress to the profile shown in outline as 3'. In accordance with the invention, the necessary increase in length of the sheet 3 to accommodate the required depression is not available by stretching that sheet, but is provided for along one or both frame members by effectively paying-out the sheet towards the centre. Having produced the depression d upon a person first sitting down, further depression d' should be available to accommodate additional loading whilst the person remains seated, for example as he changes his posture. As mentioned previously, this additional depression should increase relatively little with the applied load, as compared with the increase in the depression d with applied load which occurs as the person first sits down.

DOMESTIC OR OTHER FURNITURE SEATING

Figure 2:
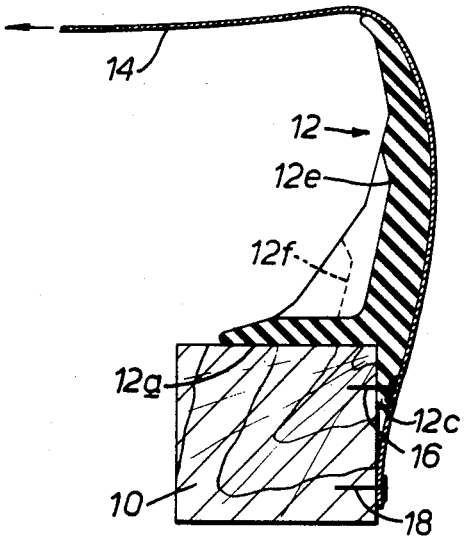
FIG. 2 is a section through a portion of a seating platform in accordance with this invention, for domestic or other furniture and showing a front frame member and an elongate elastic element disposed along it.

Referring to FIG. 2, there is shown a front member 10 of a wooden seat frame. An elongate elastic element 12 is disposed along this frame member and a sheet 14 of non-stretch material is secured along its opposite edges to this frame member and to an opposite member (not shown) of the frame, whilst lying over the elongate elastic element 12. The distance between the two frame members might, for domestic or other furniture, by say 25 inches (63.5 cm) and the required depression d (FIG. 1) at the centre about 3½ inches (8.75 cm). The total length of sheet which needs to be paid-out, in the manner described above, is less than 4 cm in this example.

Figure 3:
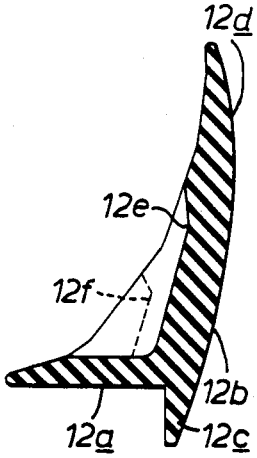
FIG. 3 is a section through the elongate elastic element of FIG. 2 in its as-moulded condition.

The element 12 in the example shown is moulded of a rubber composition of a high natural rubber content so that it will retain its elastic properties with time. The element has a base surface 12*a* which sits on the upper surface of the member 10 of the wooden frame and a lip 12*c* at its front and bottom which sits against the front surface of member 10. The element generally tapers in section towards its top, with its front surface 12*b* inclining generally forwards in the as-moulded condition of the element as shown in FIG. 3. The element is further extended downwardly at its front bottom to form the lip 12*c* which sits against the front surface of the member 10 of the wooden frame: the element is secured to the member 10 by staples 16 driven through the lip 12*c* at intervals and into the wooden member 10. An upper portion 12*d* of the front surface of the element 12 inclines rearwardly, in the as-moulded condition of the element (FIG. 3) to define a relatively sharply tapering tip of the element. The height of the element, from its base surface 12*a* to the top of its tip, may be 5.5 cm typically, and the rear surface of the element is formed with elongate grooves, comprising primary and secondary elongate grooves 12*e*, 12*f*. Typically the primary grooves 12*e* are 30 mm long and 2.5 mm wide and occur at 16 mm intervals. Between each pair of primary grooves a secondary groove 12*f* 18 mm long and 4 mm wide is positioned to relieve the longitudinal stress in the thicker, lower section of the element. The depth of each groove varies along its length, the primary groove penetrating 9 mm at its greatest depth and the secondary groove penetrating 7 mm at its greatest depth. The combination of grooves are spaced symetrically throughout the length of the element, in the example shown, but instead it is envisaged that they may differ and likewise their spacing may differ, all in the same element. Also, each groove may differ in its width along its length and its depth may exhibit a different variation from that shown, all to suit optimum operating characteristics for the final seating platform.

FIG. 2 shows that the sheet 14 of non-stretch material extends over the top of the element 12, down its smooth, uninterrupted front surface 12*b* and down the front surface of the wooden frame member 10 and is secured thereto for example by staples 18: the opposite edge of sheet 14 is similarly secured to the opposite member of the frame, the sheet 14 being applied under relatively light tension which has the effect of turning the relatively flexible tip of the element 12, as shown in FIG. 2.

Figure 4:
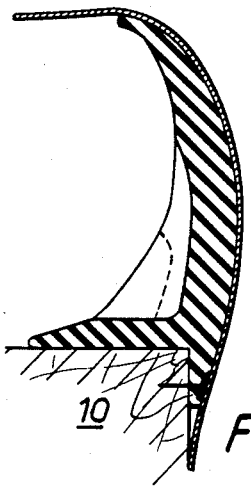
FIG. 4 is a section through the portion of seating platform shown in FIG. 2, but when the platform is loaded.

Loading of the sheet 14 imparts much greater tension to it and this increased tension is transmitted to element 12 to cause elastic deformation of the latter so as to pay-out a further amount of the non-stretch sheet 14 towards the centre of the platform to permit its desired depression. In the example shown, the effect of a person sitting on the seat is that the element 12 will be turned bodily, relative to its base, to a configuration somewhat as shown in FIG. 4: the angle through which the element is turned, in this manner, will increase with the magnitude of the loading. The deformation of the rubber element, to provide this turning, is made possible because the rubber portions between the grooves are able to expand lengthwise of the element and into those grooves, this expansion compensation for the compression of the rubber element transverse of its length which is caused by the increased tension in sheet 14.

The arrangement is preferably such that, when the seat is loaded by a person of average weight sitting still on the seat, the rubber portions on opposite sides of each primary groove 12*e* will have expanded into contact with each other, thus partly closing each such primary groove. Thereafter, further depression of the platform is available (in response to increased loading, for example upon the person changing his posture) by further bodily deformation of the rubber element, but with substantially greater resistance to depression of the platform because the rubber is no longer or much less free to expand lengthwise of the element to compensate for the further transverse compression.

The elements 12 can be moulded of a standard length appropriate to the width of a single-person seat. For a two-person or three person seat or sofa for example, two or three such elements can then be mounted end-to-end.

As mentioned previously, such elongate elastic elements may be provided along both opposite frame members, or along all four members of the frame. Whilst a wooden frame has been shown, the invention is applicable to seat frames of metal construction using appropriate means for fixing the elongate elastic elements and the non-stretch sheet. In all cases, cushions and other upholstery will be applied over the seating platform.

Figure 5:
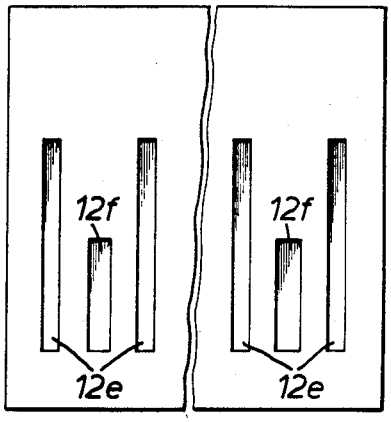
FIG. 5 is an elevation of the rear side of a portion of the elastic element.

Although in FIGS. 2 and 5 grooves are formed in the elongate elastic element to enable its material to deform and expand lengthwise of the element, as described above, the grooves may be replaced by recesses of any alternative shape, whether elongate or circular (e.g. dimples) or otherwise: also the recesses, whatever their shape, may comprise perforations extending through the element from its rear surface to its front surface.

SEATING FOR CARS OR OTHER FORMS OF TRANSPORT

Figure 6:
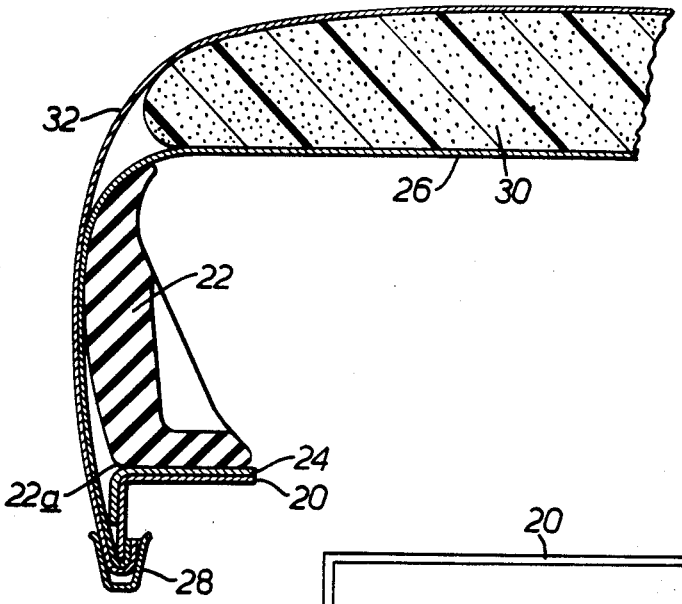
FIG. 6 is a section through a portion of a seating platform in accordance with this invention, for a car front seat, and showing one side frame member and an elongate elastic element disposed along it.
Figure 7:
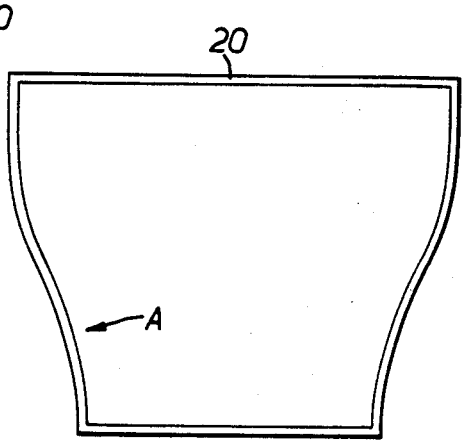
FIG. 7 is a plan view of a typical metal frame for a car front seat.
Figure 8:
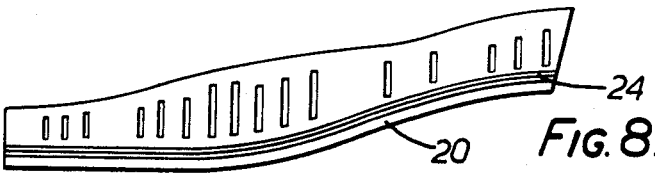
FIG. 8 is a view on the arrow A of FIG. 7 showing one side member of the frame with an elongate elastic element attached to it.

FIGS. 6 to 8 show application of the invention to a front seat of cars, trucks and vans, although the invention is also applicable to the back seat of a car, whether in the seat or back panels, and to the passenger seats for other types of transport e.g. coaches, omnibuses, trains, aeroplanes etc. For the front seat of a car, there will be provided a generally rectangular frame 20 made as a one-piece pressing, and two elongate elastic elements 22 (one shown in FIG. 6) attached along apposite side members of the frame. Each element 22 corresponds generally with the element 12 of FIGS. 2 to 5, but has a flat base bonded to a metal strip 24 which can be secured by any suitable means (e.g. bolting, rivetting or welding) to the metal frame 20. As shown, the frame 20 may be pressed to an angle section and the strip 24 may comprise a corresponding angle section. Typically, the width of the car front seat between the opposite side frame members might be 16 inches (41 cm) with the depression d (FIG. 1) required at the centre of platform being about 40–50 mm, a car seat requiring a firmer platform than a domestic seat. Thus the elements 22 for the car seat are significantly smaller in section (e.g. 30–35 mm in height) than the element 12 for the domestic seat, firstly because there are two such elements instead of one and secondly because the required depression d under loading is considerably less and therefore the length of non-stretch sheet material 26 to be paid-out is considerably less. The non-stretch sheet 26 is applied over the two elements 22 and is attached along its opposite edges to the opposite side edges of the frame 20, for example by clips 28. Conventional cushioning 30 is placed over the non-stretch sheet 26 and the usual sheet material outer trim 32 is applied over the cushioning and may be attached along its edges to the periphery of the frame 20 by the same clips 28.

Because the elements 22 are disposed along the sides of the car front seat, they serve to provide a resilient edge to the front seat to comply with the usual requirements, thus reducing the dependence on foam material in region of the seat sides. The cross-sectional size and/or shape of each element 22 may vary along its length, and/or likewise the disposition, frequency, and/or shape and size of the relieving grooves in the element, so as to vary the resilient characteristic of the element along its length (and hence the resilient characteristic of the completed seat from its front to its back). The side elements of the frame 20 may not be linear either in plan or side view (see FIGS. 7 and 8), in which case the metal strip 24 will be pre-formed of corresponding non-linear shape and likewise the elements 22 will be moulded of corresponding non-linear shape along their base surface 22*a*.

In the back panel of the seat, elements such as elements 22 may run up the opposite sides, or an opposite pair may be disposed at the lumbar level and another opposite pair at the shoulder level. In the back seat of a car, the elastic element may run along the front frame member, with two or perhaps three such elements disposed end-to-end. In each of the various cases a non-stretch sheet is applied taut over the elastic elements, and any of the other options previously described may be incorporated.

The element 22 is shown with grooves in its inwardly-facing surface, just in the manner of the grooves provided in the element 12 of FIGS. 2 to 5. Instead of the grooves, however, the element 22 may be replaced by recesses of any alternative shape, whether elongate or circular (e.g. dimples) or otherwise: also the recesses, whatever their shape, may comprise perforations extending through the element from its inwardly-facing side to its outer surface.

I claim:

1. A seating platform comprising an elongate elastic element formed from a substantially incompressible material and disposed along at least one frame member of a seat, and a sheet of non-stretch material secured along opposite edges thereof to said one frame member and an opposite frame member so as to be taut when the seat is not loaded, said sheet lying over said elongate elastic element and the arrangement being such that upon loading the seat, tension thus imparted to said sheet produces elastic deformation of said elongate element, the elongate elastic element being provided with recessed regions into which the said substantially incompressible material can deform and expand along the lengthwise axis of the element to compensate for compression of the element along axes transverse to its length, so as to permit limited depression of the platform over its loaded region.

2. A seating platform according to claim 1 wherein, as the platform is progressively loaded, the elastic element exhibits intially a first stage of deformation during which depression of the platform increases relatively greatly with increasing applied load, and subsequently a second stage of deformation during which depression of the platform increases relatively little with increasing applied load.

3. A seating platform according to claim 1 or claim 2 wherein the elastic element, in transverse cross section, tapers from a relatively wide base which is disposed adjacent the associated frame member to a relatively narrow free edge at the opposite extremity of the elastic element.

4. A seating platform according to claim 1 wherein said recesses are in the form of grooves provided in the surface of the elastic element opposite to that overlaid by the said non-stretch material.

5. A seating platform according to claim 4 wherein said grooves comprise alternate primary grooves and secondary grooves, the primary grooves being larger than the secondary grooves.

6. A seating platform according to claim 1 wherein a plurality of differently sized and/or shaped recesses are provided in the elastic element in order to produce desired deformation characteristics of the elastic element.

7. A seating platform according to any preceeding claim wherein at least some of the recesses comprise perforations extending through the elastic element from the surface thereof opposite to that overlaid by the said non-stretch material to the surface thereof which is overlaid by the said non-stretch material.

8. A seating platform according to claim 1 wherein the elastic element includes in transverse cross-section a flat base surface which rests on the associated frame member, and a front surface which extends from adjacent the forward edge of the base surface upwardly, initially forwardly and then rearwardly whereby the front surface is convex.

9. A seating platform according to claim 1 wherein the elastic element is moulded from a rubber composition having a high natural rubber content.

* * * * *